US009121166B2

(12) United States Patent
Amend

(10) Patent No.: US 9,121,166 B2
(45) Date of Patent: Sep. 1, 2015

(54) REINFORCED INSULATED FORMS FOR CONSTRUCTING CONCRETE FLOORS AND ROOFS

(71) Applicant: Victor Amend, Toronto (CA)

(72) Inventor: Victor Amend, Toronto (CA)

( * ) Notice: Subject to any disclaimer, the term of this patent is extended or adjusted under 35 U.S.C. 154(b) by 0 days.

(21) Appl. No.: 14/447,770

(22) Filed: Jul. 31, 2014

(65) Prior Publication Data

US 2014/0338286 A1 Nov. 20, 2014

Related U.S. Application Data

(62) Division of application No. 10/997,855, filed on Nov. 29, 2004, now Pat. No. 8,997,420.

(51) Int. Cl.

| | |
|---|---|
| ***E04B 5/19*** | (2006.01) |
| ***E04B 1/16*** | (2006.01) |
| ***E04B 2/86*** | (2006.01) |
| ***E04C 2/22*** | (2006.01) |
| ***E04C 5/06*** | (2006.01) |
| ***E04C 2/20*** | (2006.01) |

(52) U.S. Cl.

CPC . *E04B 5/19* (2013.01); *E04B 1/167* (2013.01); *E04C 2/205* (2013.01); *E04C 5/06* (2013.01); *E04B 2/8617* (2013.01); *E04B 2002/867* (2013.01)

(58) Field of Classification Search

CPC . E04B 1/167; E04B 2/8617; E04B 2002/867; E04B 5/19; E04C 2/205; E04C 5/06

USPC ..... 52/289, 326, 332, 333, 335, 426, 442

See application file for complete search history.

(56) References Cited

U.S. PATENT DOCUMENTS

| | | | | |
|---|---|---|---|---|
| 1,058,548 | A * | 4/1913 | Cancalon | 52/328 |
| 2,376,761 | A * | 5/1945 | Fahy | 52/853 |
| 2,418,383 | A * | 4/1947 | Wennberg et al. | 52/857 |
| 3,253,332 | A * | 5/1966 | Howlett et al. | 29/506 |
| 3,340,664 | A * | 9/1967 | Reiland | 52/649.1 |
| 4,133,156 | A * | 1/1979 | Unger | 52/383 |
| 4,240,233 | A * | 12/1980 | Vercelletto | 52/127.3 |
| 4,587,782 | A * | 5/1986 | Shubow | 52/251 |
| 4,619,096 | A * | 10/1986 | Lancelot, III | 52/848 |
| 4,627,212 | A * | 12/1986 | Yee | 52/848 |
| 4,811,770 | A * | 3/1989 | Rapp | 52/309.12 |
| 4,877,463 | A * | 10/1989 | Aicher et al. | 148/644 |
| 7,784,235 | B2 * | 8/2010 | Cretti | 52/332 |
| 7,954,291 | B2 * | 6/2011 | Cretti | 52/309.16 |

* cited by examiner

*Primary Examiner* — Michael Safavi

(57) ABSTRACT

A panel for a building form made of insulating material such as polystyrene is integrated with a reinforcing member for enabling the panel to resist deformation due to forces applied against its concrete-facing surface. Reinforcement of floor/roof panels is beneficial to reduce the amount of, or eliminate the need for, shoring for supporting the weight of wet concrete or workers. The reinforcement resists against deformation due to cracking, splitting etc. Reinforcement is likewise beneficial for wall forms where the weight of concrete asserts significant pressure against the concrete-facing surface of the form, in order to resist deformation of the wall forms under pressure. The reinforcing member may be made of a plastic material such as polypropylene or high-impact polystyrene. Methods of manufacturing reinforced form panels are disclosed.

42 Claims, 5 Drawing Sheets

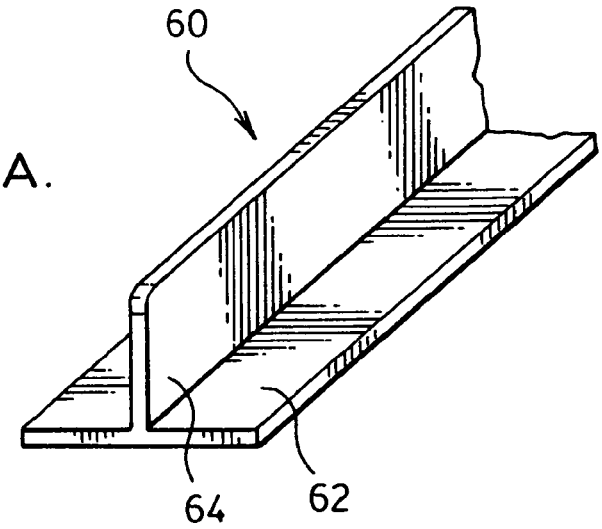
FIG. 4A.
FIG. 2A.
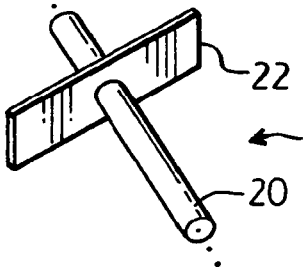
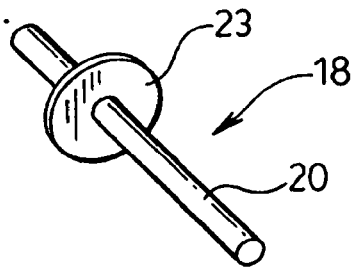
FIG. 5.

REINFORCED INSULATED FORMS FOR CONSTRUCTING CONCRETE FLOORS AND ROOFS

CROSS-REFERENCE TO RELATED APPLICATION

This application is a division of U.S. patent application Ser. No. 10/997,855 filed on Nov. 29, 2004, the content of which is incorporated herein by reference in its entirety.

FIELD OF THE INVENTION

The following is directed in general to insulating forms for building structural walls, floors and roofs, and more particularly to such insulating forms having integrated reinforcement.

BACKGROUND OF THE INVENTION

Construction forms are known for molding poured concrete walls, floors, roofs and the like. When making walls, forms generally comprise a pair of spaced panels that define an outer surface of the walls and the forms are intended to be removed once the concrete is set. More recently, thermal properties of the walls has been given more consideration, as has the need to incorporate thermal insulation in the walls.

For example, U.S. Pat. No. 6,536,172 to Amend discusses an insulating wall form comprising a pair of panels made of polystyrene arranged in a spaced parallel relationship. Bridging ties span between and respective ends are embedded in the panels to hold the form shape during pouring of a concrete charge in between the panels. The bridging ties include retainer arms for securing reinforcement bars during pouring of the concrete. Once the concrete sets, a structurally sound wall results having thermal insulation on both of its sides. The bridging ties include T-shaped end plates that are embedded in the panels and act against the great weight of the wet concrete to prevent the insulating panels from being forced apart during pouring.

Such forms are generally sufficient for withstanding forces from wet concrete for walls of moderate thickness and height. However, when constructing walls having large heights and thicknesses, accordingly larger forces are being applied to the forms. It has been found that these larger forces are significant enough to split or otherwise deform the polystyrene form. In particular, force against the concrete-facing surface of the form tends to transmit tension to the outward facing surface, causing a split in the form. The wet concrete flows through the split, compromising the integrity of the wall and forcing the insulation apart. While other form materials may be used having physical properties that resist deformation, those same materials generally do not have the insulating properties of polystyrene or similar materials. While materials such as polystyrene are excellent for insulation because, they do not generally have physical properties ideal for resisting deformation or splitting due especially to tension.

Prior approaches to this problem involved applying additional, more frequently-spaced bridging ties. However, as would be understood, additional bridging ties consumes additional cost and labour time. Furthermore, with an increase in the number of bridging ties molded transversely into the concrete, it is possible that the strength of the concrete itself can be compromised.

Thermal insulation has also been recognised as beneficial for concrete floors and roofs. While pouring floors or roofs, the wet concrete is unable to support its own weight, since it has not yet bonded sufficiently for self-support and support of additional loads. Furthermore, prior art insulated concrete forms for floors and roofs made of polystyrene and similar materials do not have the structural integrity to receive great volumes of poured concrete. As such, supporting shoring or scaffolding is generally required every so many feet underneath the forms to support the weight. Even without the concrete, shoring is generally recommended to support the weight of construction workers walking overhead with spans more than a few feet. While thicker forms having greater resistance to splitting may be used, it is clear that the floor or roof must also be accordingly thicker. In some applications this is unacceptable as it decreases room volume etc.

The above-described problem with floor and roof forms has not been addressed in the art. For example, Insul-Deck of Florence, Ky., U.S.A. provide a concrete form for floors and roofs. Insul-Deck's forms are considered state of the art but still require extensive shoring during construction to maintain the weight of wet concrete prior to setting. Once the concrete has set, the shoring may be removed because the concrete bonds to support itself. Furring strips running the length of the form may be integrated with the form. However, due to the furring strips' relationship with the form, at best they marginally increase the weight-bearing ability of the form. As such, the furring strips are not sufficient in configuration for supporting the weight of poured concrete or even a construction worker for spans more than a few feet. In fact, depending on the method by which the furring strips have been integrated with the form, their presence may in fact weaken a form's weight-bearing ability, possibly necessitating further shoring underneath.

It is object of an aspect of the present invention to provide panels for forms for molding walls, floors, roofs and the like of concrete that address at least some of the above-described deficiencies.

SUMMARY OF THE INVENTION

It has been found that a reinforcing member integrated with a panel of an insulating building form provides improved strength in the panel sufficient to withstand the force of poured concrete, workers and the like. Such strength improvements in the panel enable it to be used in a floor/roof form with far less shoring, or in a wall form such that additional bridging ties are not required to resist deformation of the panel. Once concrete has set, the concrete supports its own weight and that of the building of which it is a part.

According to the invention, an insulating form comprises a panel made of an insulating material, the panel having a concrete-facing surface and an outward facing surface; at least one reinforcing member integrated with the panel, the reinforcing member arranged with respect to the panel to limit deformation of the panel during application of force against the concrete-facing surface.

The reinforcing member may be rebar or skeleton within the panel, or a layer or mesh of reinforcing material applied to at least one of the concrete-facing and outward-facing surfaces. A number of configurations of reinforcing member are possible, the main function being to absorb force being applied to the concrete-facing surface of the panel so as to resist deformation due to cracking, splitting and the like.

The reinforcing member may be made of a plastic, such as polypropylene or high-impact polystyrene. The reinforcing member may alternatively be made of wood, metal, or any other appropriate material. The material used for the reinforcing member must withstand compression and/or tension, depending upon its location relative to the concrete-facing surface.

Curves or angles in the reinforcing member at panel curves or angles may be reinforced by thickening the reinforcing member at the curve, or adding a reinforcer to the curve portion.

According to a further aspect of the invention, an insulating wall form comprises a panel made of an insulating material, the panel having a concrete-facing surface and an outward facing surface, the panel adapted to be in a fixed spaced relationship with another panel to form a concrete chamber for receiving a charge of poured concrete; at least one reinforcing member integrated with the panel, the reinforcing member arranged with respect to the panel to limit deformation of the panel during application of force against the concrete-facing surface.

The wall form panel may be adapted to be in a fixed spaced relationship with the other panel by being also integrated with bridging ties connectable to the other panel. The reinforcing member may include clips for securing the reinforcing member to portions of the bridging ties during manufacture of the panel.

According to yet another aspect of the invention, an insulating floor/roof form comprises a panel made of an insulating material, the panel having a concrete-facing surface and an outward facing surface, the panel also having at least one abutting surface for abutting a respective adjacent panel; at least one reinforcing member integrated with the panel, the reinforcing member arranged with respect to the panel to limit deformation of the panel during application of force against the concrete-facing surface.

The floor/roof panel may include inlets for receiving respective building joists. If this is so, the reinforcing member, whether it be a skeleton, rebar, mesh or continuous layer applied to the panel surface(s) must accommodate the inlets. The reinforcing member may reinforce the inlets where necessary or desired.

According to a further aspect of the invention, a method of manufacturing a reinforced panel for an insulating form comprises forming a panel of insulating material, the panel having a continuous surface; forming a continuous sheet of reinforcing material; and affixing the continuous sheet to the continuous surface to integrate the reinforcing material with the panel.

The continuous sheet may be adhered or laminated across the entire continuous surface to improve the transmission of force to the sheet.

According to still yet a further aspect of the invention, there is provided a method of manufacturing a reinforced panel for an insulating form. The method comprises putting at least one reinforcing member within a mold; placing a volume of insulating material into the mold; causing the volume of insulating material to expand to fill the mold and fuse together; wherein upon expansion, the reinforcing member is integrated with said panel.

The insulating material may be expandable polystyrene (EPS), and the EPS is caused to fill the mold by application of heat to the mold.

The reinforcing member may be placed at a midpoint in the mold to be encapsulated by the insulating material, or at a side of the mold. If at the side, the reinforcing member ideally fuses to the insulating material. Panels may benefit from the use of a high impact polystyrene reinforcing member where EPS is used, as the reinforcing member can fuse to the EPS to provide an excellent transmission of force applied at surfaces of the panel to the reinforcing member.

Another aspect of the invention is a method of manufacturing a reinforced panel for an insulating form. The method comprises molding a panel of insulating material, the panel having a concrete-facing surface and an outward-facing surface; and applying a layer of plastic to at least one of the outward-facing surface and the concrete-facing surface.

The layer of plastic may be laminated to the panel using a heat-treatment, an adhesive, or some other appropriate means such as applying a liquid plastic layer and causing the liquid plastic to fuse to the panel.

The primary benefit accruing from a reinforcing member in the insulating panel is that the form is able to withstand far greater forces against its concrete-facing surface than such a panel without reinforcement. Floor or roof form panels incorporating such a reinforcing member can withstand the downward weight of workers or wet concrete without requiring frequent shoring. Wall forms likewise receive a benefit, as the force applied outward by wet concrete is absorbed by the reinforcing member instead of solely by the panel. As such, less time is spent building, aligning and applying shoring for the floor/roof forms, and wall forms do not have to be supported additional bridging ties.

These together with other aspects and advantages, which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

A detailed description of the preferred embodiment is set forth in detail below, with reference to the following drawings, in which:

FIG. 2A is a perspective view of a portion of the reinforcing rebar of FIG. 2;

FIG. 4A is a perspective view of a portion of the reinforcing skeleton of FIG. 4; and FIG. 5, shown on the same sheet as FIG. 2A, is a cross-sectional view of an alternate reinforcing rebar suitable for use in the wall form of FIG. 1.

DETAILED DESCRIPTION OF THE PREFERRED EMBODIMENT

According to the invention in its most general aspect, a reinforcing member is integrated with a building form panel for absorbing forces applied against the concrete-facing surface of the panel. Such reinforcement enables the panel to resist deformation due to cracking, splitting and the like when it is under force during construction.

Wall Form

Figure 1:
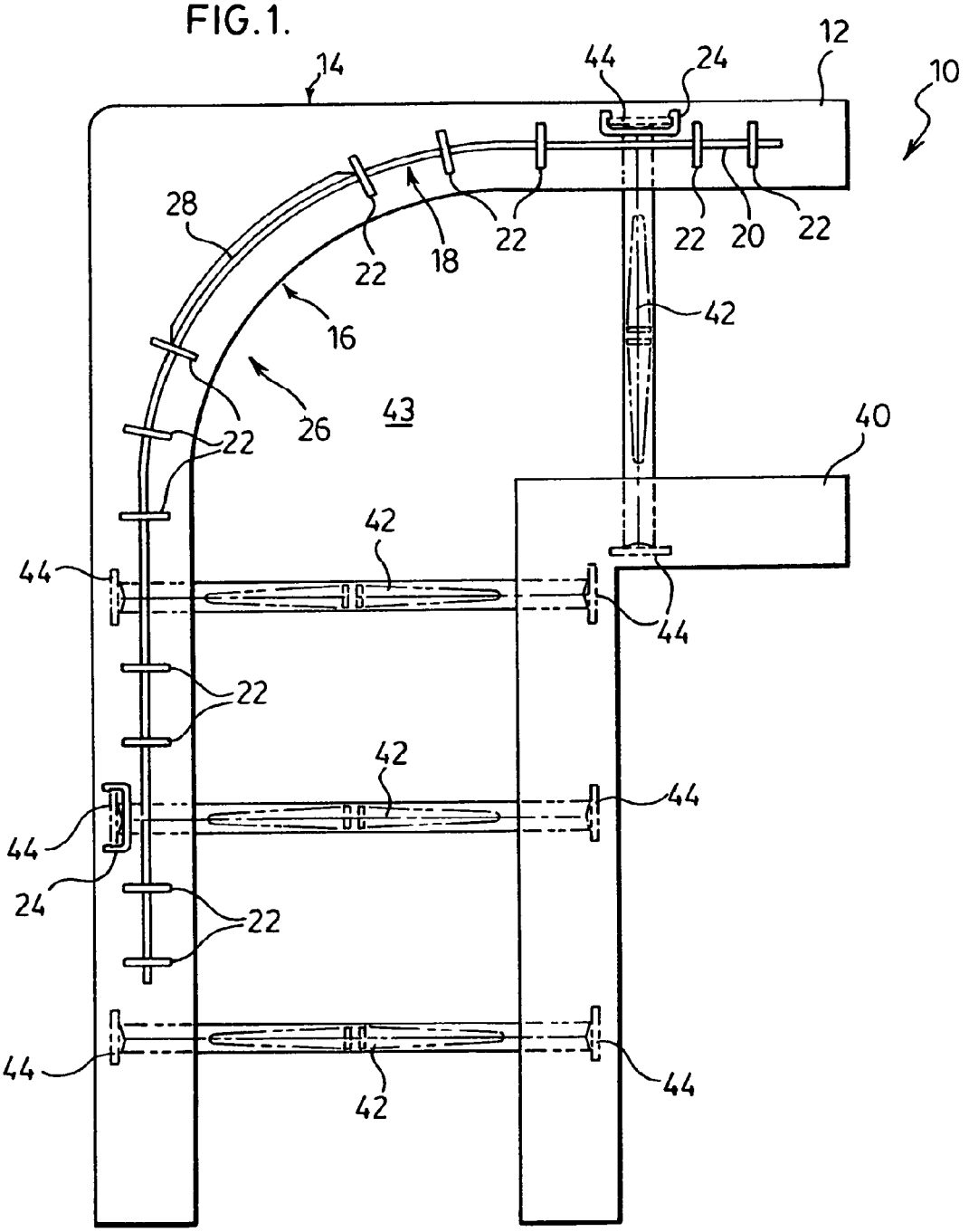
FIG. 1 is a top cutaway view of a wall form with an outer panel having an integrated reinforcing rebar.

FIG. 1 shows a top cutaway view of a portion of a wall form 10 for a building corner. Wall form 10 comprises outer panel 12, and inner panel 40.

Outer panel 12 is made of polystyrene, and is held in a fixed spaced relationship with inner panel 40, also made of polystyrene, by bridging ties 42 to form concrete chamber 43.

Concrete chamber 43 is generally an elongate channel into which the concrete charge is poured. Outer panel 12 has an outward-facing surface 14 and a concrete-facing surface 16. A description of a similar wall form may be found in U.S. Pat. No. 6,536,172, the disclosure of which is incorporated by reference.

It can be seen in FIG. 1 that integrated with outer panel 12 of outer form 10 is a plastic rebar 18 for absorbing forces applied against concrete-facing surface 16 of outer panel 12 when wet concrete is poured into concrete chamber 43.

Figure 2:
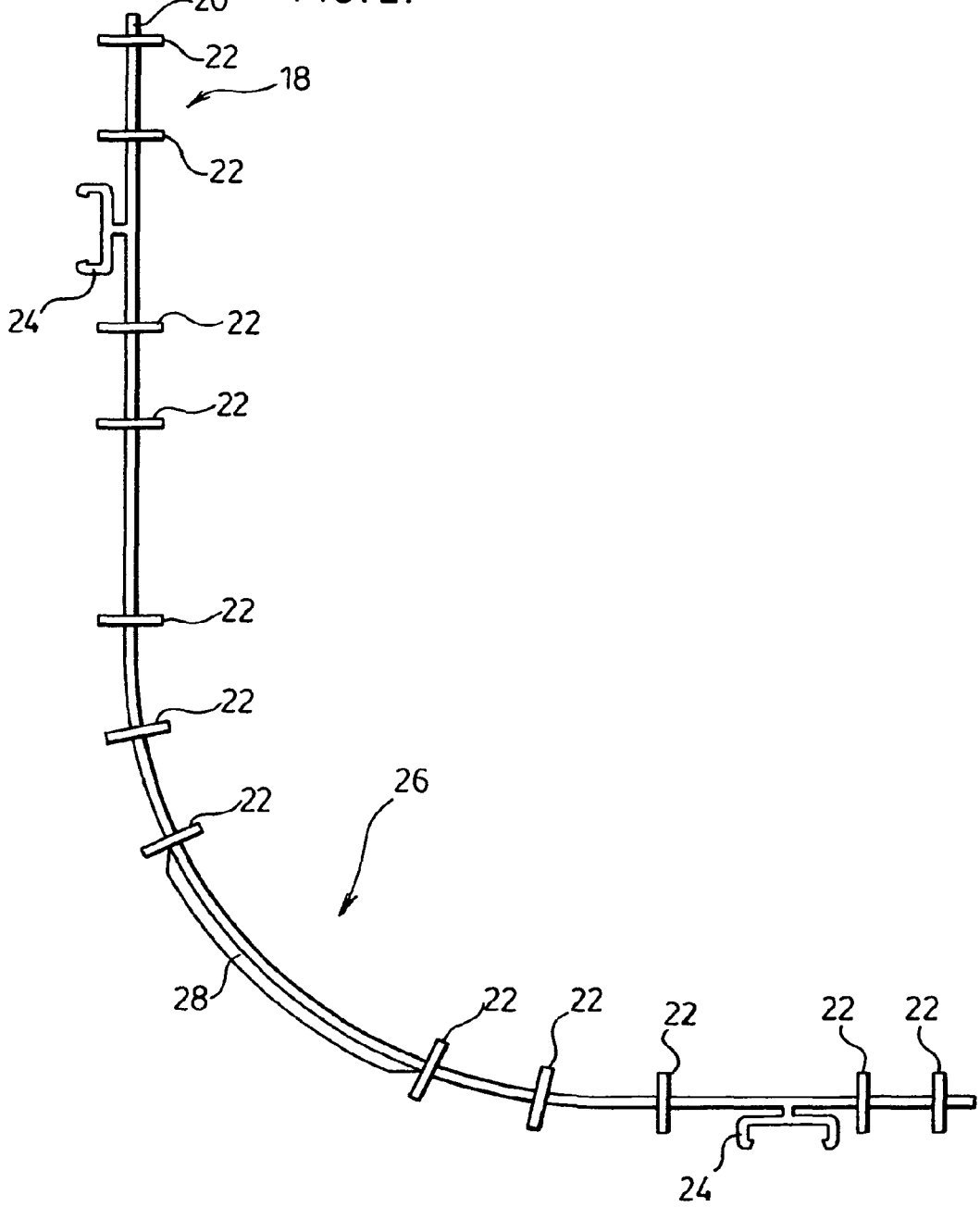
FIG. 2 is a top view of the reinforcing rebar of FIG. 1, in isolation.

Rebar 18 is shown in isolation in FIG. 2. Rebar 18 comprises a shaft 20 along which is fixed a plurality of protruding fingers 22. Tie clips 24 extend from shaft 20 and fix shaft 20 to respective bridging ties 42. At curve 26, rebar 18 has a curve reinforcer 28, also made of plastic.

Fingers 22 are spaced along shaft 20 for the purpose of preventing shaft 20 from sliding relative to outer panel 12 when force is applied against concrete-facing surface 16 due to concrete being poured into concrete chamber 43. Without fingers 22 or some equivalent, shaft 20 might not bind sufficiently well to outer panel 12 and would therefore be of little use for absorbing compression or tension forces applied to outer panel 12.

Tie clips 24 are useful for fixing shaft 20 to bridging ties 42 during manufacture of the wall form, as will be described later in this document.

Curve reinforcer 28 of rebar 18 at curve 26 provides additional strength for receiving compression or tension force as needed due to the larger forces that are applied in that area of concrete chamber 43.

FIG. 2A is a perspective view of a portion of rebar 18 showing shaft 20 and fingers 22.

Floor/Roof Form

Reinforcement is very useful in roof/floor forms for reducing or eliminating required shoring. Not only does the reinforcement assist when concrete is poured, but also when workers are walking across the roof/floor forms during construction.

Figure 3:
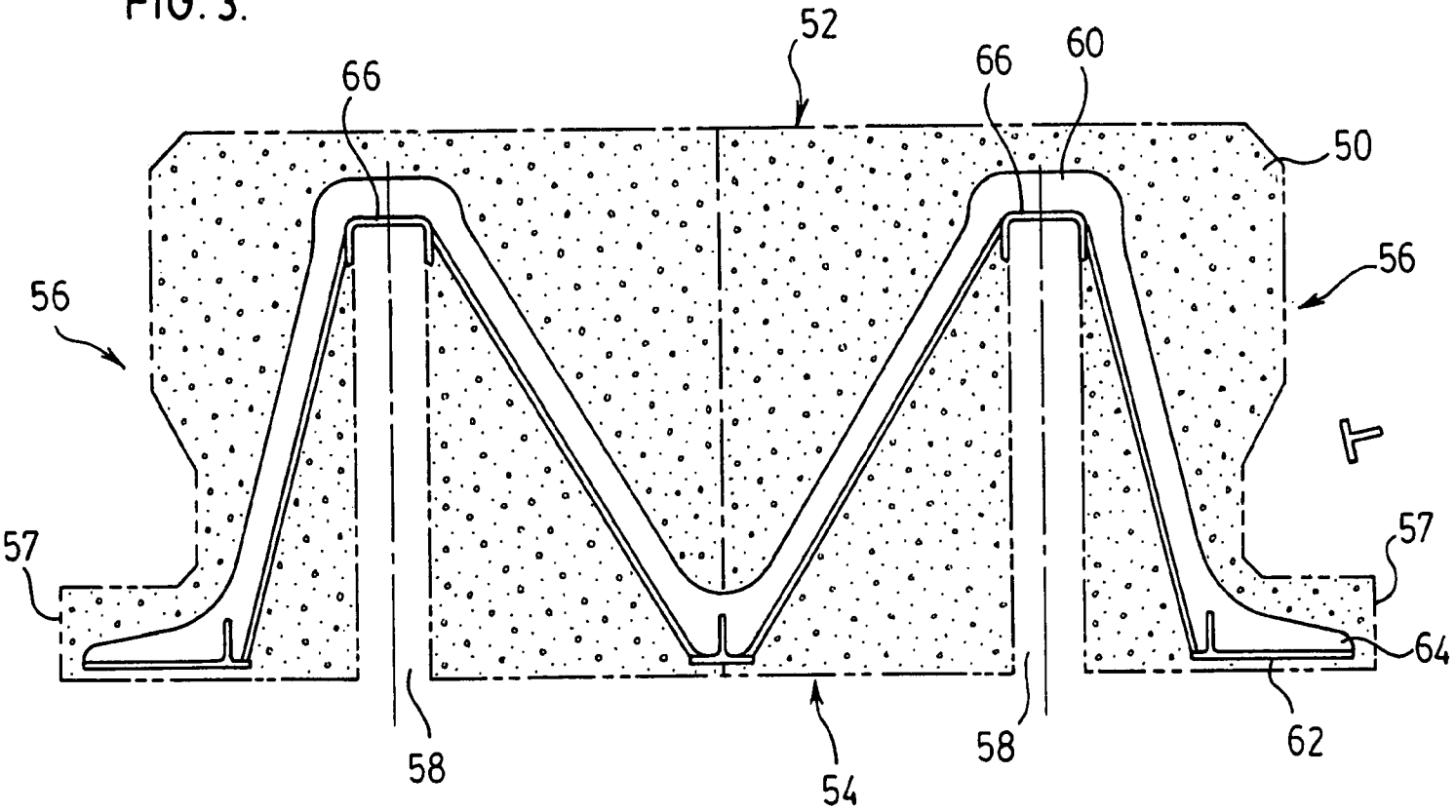
FIG. 3 is a cross-sectional end view of a panel for a roof/floor form having an insulating panel and a reinforcing skeleton.

FIG. 3 is an end cutaway view of a panel 50 for use in a concrete floor/roof form. Panel 50 is made of an insulating material such as polystyrene. Panel 50 has a concrete-facing surface 52 and an outward-facing surface 54. Panel 50 includes inlets 58 for receiving a building joist during installation, and two abutting sides 56 with respective abutting surfaces 57 for abutting adjacent panels (not shown). Abutting sides 56 are profiled so as to form with adjacent panels a T-shape channel that may be filled with poured concrete for forming a beam.

Embedded in panel 50 is a reinforcing skeleton 60. The term "skeleton" is generally used by the layman and skilled workers alike with reference to a supporting framework or structure for something. In this specification, however, the term "skeleton" is to be understood to mean a framework or structure for supporting the panel when it is under stress. In particular, unlike the human skeleton, which is required to support the shape and general character of the human body whether or not it is under stress, reinforcing skeleton 60 is not required to support the shape and general character of polystyrene panel 50 when it is not under stress. As will be described below, reinforcing skeleton 60 is integrated with panel 50 in order to support its shape and general character particularly when it is under stress due to force applied onto concrete-facing surface 52.

With skeleton 60, panel 50 can withstand significantly more force against its concrete-facing surface 52 before deforming by cracking, splitting etc. As would be understood, there is generally always a limit to how much force any physical object can withstand without deforming by cracking, splitting etc. However, for the purposes described herein, the threshold at which such deformation of panel 50 occurs is significantly greater with the integrated reinforcing skeleton 60. For example, when inlets 58 of panel 50 have received respective building joists and panel 50 is thereby installed, the weight of workers or wet concrete against concrete facing surface 52 is transmitted to skeleton 60, which resists deformation of panel 50. The combination of panel 50 and skeleton 60 integrated therewith is a form having excellent thermal insulating properties and excellent resistance to deformation.

As can be seen in FIG. 3, skeleton 60 also comprises inlet supports 66 at the top of respective inlets 58 of panel 50 for hanging panel 50 over the joists in the building. Inlet supports 66 ensure that the relatively little amount of polystyrene through the short distance between the top of inlets 58 and concrete-facing surface 52 is reinforced. This is so the weight of panel 50, workers overhead and wet concrete poured thereon does not crack or split the panel 50 at the inlets 58.

FIG. 4A is a perspective view of a portion of skeleton 60. As can be seen, skeleton 60 comprises a mesh 62 and a spine 64, to be described in more detail below.

Figure 4:
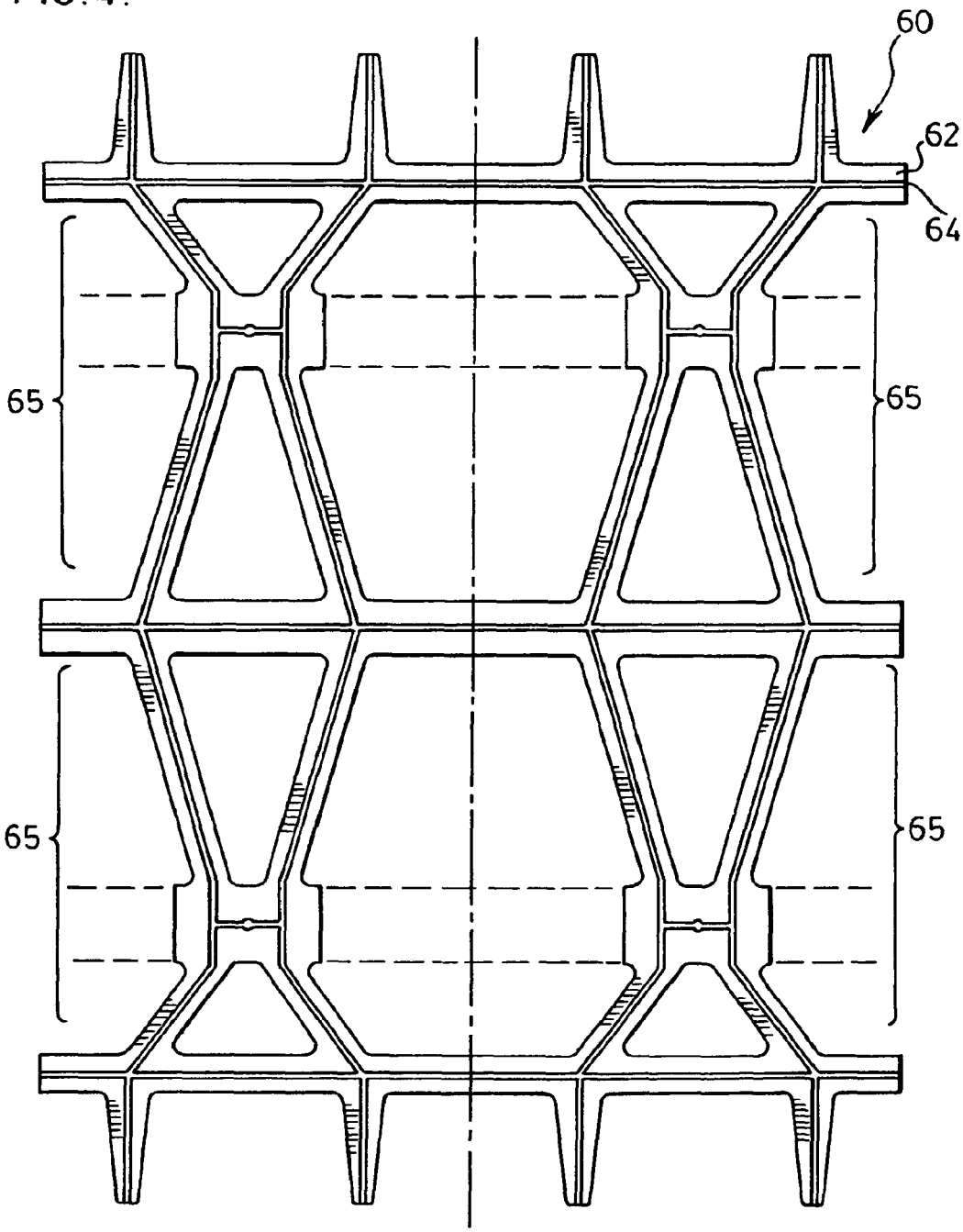
FIG. 4 is a top view of the reinforcing skeleton of FIG. 3, in isolation.

FIG. 4 shows skeleton 60 from the top, in isolation from panel 50. Skeleton 60 comprises a number of interconnected H-shaped portions 65. Skeleton 60 is formed in this generally non-continuous configuration, as opposed to being a continuous sheet, in order to provide required support while not fully separating portions of panel 50 into upper and lower segments. While it is conceivable that a continuous sheet could be sandwiched between top and bottom portions, by use of the non-continuous configuration, skeleton 60 may be effectively encapsulated by expanded and fused expandable polystyrene into panel 50 during molding of panel 50.

Spine 64 of skeleton 60 extends away from mesh 62 in order to provide a similar function to that of fingers 22 of rebar 18 for the outer panel 12 of FIG. 1. That is, the combination of spine 64 and mesh 62 acts to grip panel 50 so as to prevent panel 50 from sliding relative to skeleton 60 when force is applied. If a reinforcing member is able to slide under force relative to that which it is to reinforce, any force applied will not be absorbed as well by the reinforcing member.

Manufacturing Forms Having Reinforced Panels

In order to make the reinforced wall form of FIG. 1, rebar 18 is formed and placed at a midpoint in a mold, and the mold is then filled with expandable polystyrene (EPS). The EPS is caused to expand by application of heat to the mold, and the EPS surrounds and encapsulates rebar 18. The mold is opened, and the reinforced panel 12 removed. Post-molding operations may include using a hotwire or coldwire to cut protrusions and cavities for stacking panels 12. Alternatively, the mold may be shaped as appropriate to form the protrusions and cavities.

In order to make the reinforced floor/roof form of FIG. 3, skeleton 60 is formed and placed at a midpoint in a mold, and the mold is then filled with expandable polystyrene (EPS). The EPS is caused to expand by application of heat to the mold, and the EPS surrounds and encapsulates skeleton 60. The mold is opened, and the reinforced panel 50 removed. Post-molding operations may include using a hotwire or coldwire to cut abutting sides 56 or inlets 58. However, inlets 58 may be formed as part of the mold shape, and skeleton 60 rests in the mold on its inlet supports 66. Alternatively, the mold may be shaped as appropriate to form profiled abutting sides 56.

The many features and advantages of the invention are apparent from the detailed specification and, thus, it is intended by the appended claims to cover all such features and advantages of the invention that fall within the true spirit and scope of the invention. Further, since numerous modifications and changes will readily occur to those skilled in the art, it is not desired to limit the invention to the exact operation illustrated and described, and accordingly all suitable modifications and equivalents may be resorted to, falling within the purpose and scope of the invention.

For example, while rebar 18 for the wall form panel 10 has been shown with a shaft 20 and fingers 22, it will be understood that any suitable configuration of rebar would suffice that functions to have rebar 18, rather than panel 12 alone, absorb forces applied to concrete-facing surface or outward-facing surface of panel 12. FIG. 2A shows an example of a portion of an alternate rebar 18. Alternate rebar 18 in FIG. 2A shows one of multiple protruding discs 23 on shaft 20, rather than protruding fingers 22. Shaft 20 could be cylindrical or another suitable shape, as may be desired. Furthermore, rebar 18 could be made of alternative materials, such as steel, wood and the like. The materials must be able to withstand compression and/or tension as may be the case.

It is conceivable that non-continuous configurations such as those similar to skeleton 60 would be suitable for use in a wall form. For instance, skeleton 60 could be a number of rebars such as that shown in FIG. 2. The rebars could be interconnected and even form the H-shaped configuration that the mesh-spine skeleton is shown to in FIG. 4. Such configurations would benefit from tie clips 24 or some other means by which the mesh could be held in place in a mold to bridging ties 42 during molding. Other configurations that may be conceived are within the scope of the invention.

While a generally interconnected H-shaped mesh skeleton 60 has been shown for floor/roof panel 50, it will be understood that other configurations and shapes may be employed. For instance, various configurations of grids or chain-links could also be used, or steel or plastic sheets having a number of holes therethrough for enabling the EPS to encapsulate the reinforcing member(s). Where a panel 50 is without inlets 58, planar meshes, cages, sheets or grids, or corrugated materials may be considered, as inlets 58 would not have to be accommodated or supported. The function that a reinforcing member must perform in general is to absorb forces applied to concrete-facing surface that would otherwise deform, break or split panel 50. Ideally, for ease of installation of panels, the reinforcing member is lightweight. Either polypropylene or high impact polystyrene is preferred as it has the ability to withstand compression/tension and is also lightweight. When manufacturing a reinforced building panel, the reinforcing member should be able to generally maintain its character through being heated. Should high-impact polystyrene be chosen, depending on the method of manufacture there may be advantages to reinforcement because the EPS and the high impact polystyrene can bond or fuse together somewhat to produce a more unitary reinforced structure.

It is conceivable that the reinforcing member can be laminated to a panel after the panel has been molded. In this instance, a sheet of reinforcing material can be laminated to either the concrete-facing surface or the outward-facing surface or both, in order to absorb compression or tension on the panel, as may be the case. A panel of insulating material would be made in a mold, and then the reinforcing member laminated like a skin across a surface that is subject to expansion or tension due to applied force of wet concrete.

Reinforcing member could be applied to the panel as a liquid layer of plastic or the like, which subsequently fuses to the panel.

Reinforcing member can be in several configurations, such as a planar continuous sheet, a mesh, grid or chain link, as long as it is integrated with the panel to resist deformation of the panel under force. It is not necessary that the reinforcing member provide any structural integrity to the building once constructed. However, it is conceivable that as a beneficial consequence some structural building support could result.

While panel 50 has been shown with two inlets 58, it will be understood that panel 50 may be manufactured to have any number of inlets 58, as may be required by the application. For some applications, panel may not receive joists as described but may be supported in another manner, in which case inlets 58 for joists will not be required. As will also be understood, the configuration and shape of skeleton 60 may be changed also to accommodate different configurations of panel.

The floor/roof panel may be manufactured with a first cavity in a front surface thereof, and a first extension in the front surface. This enables the panel to be interconnected with an adjacent panel. For ease of installation, the floor/roof panel may be made to be "reversible", wherein the panel has a second cavity and a second extension in a rear surface. In this manner, where the second cavity is opposite the first extension and the second extension is opposite the first cavity, the panel may be connected to an adjacent like panel no matter which one of the front or rear surfaces faces the adjacent panel.

What is claimed is:

1. An insulating form comprising:

a panel made of an insulating material, said panel having a concrete-facing surface and an outward facing surface;

at least one reinforcing member integrated with said panel, said reinforcing member arranged with respect to said panel to limit deformation of said panel during application of force against said concrete-facing surface, said at least one reinforcing member being configured to accommodate at least two supporting elements that are non-integral with said at least one reinforcing member for keeping said panel in place during and after concrete pouring, wherein said reinforcing member is a skeleton within said panel, wherein said form is an insulating floor/roof form and wherein said panel has at least one abutting surface for abutting a respective adjacent panel, and further comprising at least two inlets formed in said outward facing surface of said panel, each inlet for receiving a respective supporting element, each supporting element being a joist of a building.

2. The form of claim 1, wherein said skeleton comprises a plurality of rebars.

3. The form of claim 2, wherein at least one of said plurality of rebars comprises a shaft with at least one protrusion extending outwards therefrom, said at least one protrusion for securing the rebar within said panel.

4. The form of claim 2, wherein each of said plurality of rebars is made of one of high impact polystyrene; polypropylene; another plastic; wood; and metal.

5. The form of claim 2, wherein said plurality of rebars are interconnected.

6. The form of claim 5, wherein said plurality of rebars are interconnected as generally H-shaped portions.

7. The form of claim 1, wherein said skeleton is made of one of high impact polystyrene; polypropylene; another plastic; wood; and metal.

8. The form of claim 1, wherein said skeleton comprises a mesh.

9. The form of claim 8, wherein said skeleton further comprises a spine projecting away from said mesh.

10. The form of claim 1, wherein said panel has a first cavity in a front surface thereof.

11. The form of claim 10, wherein said panel has a first extension in said front surface.

12. The form of claim 11, wherein said panel has a second cavity and a second extension in a rear surface thereof, said second cavity opposite said first extension and said second extension opposite said first cavity.

13. The form of claim 1, wherein said skeleton is dimensioned to support said panel over said at least two inlets.

14. The form of claim 13, wherein said skeleton comprises a plurality of interconnected, generally H-shaped portions.

15. The form of claim 1, wherein said at least one abutting surface is part of a respective abutting side of said panel, said respective abutting side dimensioned to, in combination with said adjacent panel, form a channel.

16. An insulating floor/roof form comprising:

a panel made of an insulating material, said panel having a concrete-facing surface and an outward facing surface, said panel also having at least one abutting surface for abutting a respective adjacent panel;

at least one reinforcing member integrated with said panel, said reinforcing member arranged with respect to said panel to limit deformation of said panel during application of force against said concrete-facing surface; and at least two inlets formed on said outward facing surface, each inlet for accommodating a supporting element for keeping said panel in place during and after concrete pouring, each supporting element being non-integral with said at least one reinforcing member and being further accommodated by said at least one reinforcing member, wherein said at least one reinforcing member is dimensioned to accommodate said at least two inlets.

17. The form of claim 16, wherein said reinforcing member is a skin applied to at least one of said concrete-facing surface and said outward-facing surface.

18. The form of claim 17, wherein said skin is made of one of high impact polystyrene; polypropylene; another plastic; wood; and metal.

19. The form of claim 17, wherein each supporting element is a joist of a building.

20. The form of claim 19, wherein said skin is dimensioned to accommodate said at least two inlets.

21. The form of claim 17, wherein said skin is laminated to said panel.

22. The form of claim 16, wherein said reinforcing member is a mesh laminated to said outward-facing surface of said panel.

23. The form of claim 22, wherein each supporting element is a joist of a building.

24. The form of claim 23, wherein said mesh is dimensioned to accommodate said at least two inlets.

25. The form of claim 22, wherein said mesh is made of one of high impact polystyrene; polypropylene; another plastic; wood; and metal.

26. The form of claim 16, wherein said reinforcing member is a skeleton within said panel.

27. The form of claim 26, wherein said skeleton comprises a plurality of rebars.

28. The form of claim 27, wherein said plurality of rebars are interconnected.

29. The form of claim 28, wherein said plurality of rebars are interconnected as generally H-shaped portions.

30. The form of claim 27, wherein each of said plurality of rebars is made of one of high impact polystyrene; polypropylene; another plastic; wood; and metal.

31. The form of claim 27, wherein at least one of said rebars comprises a shaft with at least one protrusion extending outwards therefrom, said at least one protrusion for securing the rebars within said panel.

32. The form of claim 26, wherein said skeleton is made of one of high impact polystyrene; polypropylene; another plastic; wood; and metal.

33. The form of claim 26, wherein said skeleton comprises a mesh.

34. The form of claim 33, wherein said skeleton further comprises a spine projecting away from said mesh.

35. The form of claim 26, wherein said at least two inlets are formed in said outward facing surface of said panel, and wherein each supporting element is a joist of a building.

36. The form of claim 35, wherein said skeleton comprises at least two inlet supports, each inlet support for reinforcing an adjacent respective one of said at least two inlets.

37. The form of claim 36, wherein said skeleton comprises a plurality of interconnected, generally H-shaped portions.

38. The form of claim 16, wherein said at least one abutting surface is part of a respective abutting side of said panel, said respective abutting side dimensioned to, in combination with said adjacent panel, form a channel.

39. The form of claim 16, wherein said at least one reinforcing member is rebar within said panel.

40. The form of claim 39, wherein said rebar comprises a shaft with at least one protrusion extending outwards therefrom, said at least one protrusion for securing said rebar within said panel.

41. The form of claim 39, wherein said rebar is made of one of high impact polystyrene; polypropylene; another plastic; wood; and metal.

42. The form of claim 39, wherein each supporting element is a joist of a building.

* * * * *